US005281179A

United States Patent [19]

Wu

[11] Patent Number: 5,281,179

[45] Date of Patent: Jan. 25, 1994

[54] TOY AIRCRAFT CAPABLE OF CIRCLING IN CHANGEABLE RADIUS

[76] Inventor: Hans Wu, No. 78, Chung Shan 5th Street, Tainan City, Taiwan

[21] Appl. No.: 48,470

[22] Filed: Apr. 16, 1993

[51] Int. Cl.[5] ..... A63H 27/18; A63H 27/14

[52] U.S. Cl. ..... 446/68; 446/61

[58] Field of Search ..... 446/68, 61, 63, 64, 446/65, 66, 30, 33, 56, 57, 58, 59, 60; 244/16

[56] References Cited

U.S. PATENT DOCUMENTS 3,246,425 4/1966 Miller ..... 446/61
4,235,040 11/1980 Trowbridge ..... 446/68
5,026,313 6/1991 Meyer ..... 446/64

*Primary Examiner*—Mickey Yu
*Attorney, Agent, or Firm*—Pro-Techtor International

[57] ABSTRACT

A toy aircraft capable of circling in changeable radius which includes a fuselage and two rudders disposed on the wings, wherein multiple weight-adjusting recesses are longitudinally arranged on a top portion of the fuselage and arranged on upper rear positions of the wings at predetermined intervals, whereby multiple weight-adjusting ball members can be placed in the recesses and the locations or weight of the ball members can be changed to freely adjust the weight and gravitational center of the toy aircraft, at least one of the rudders being slightly inclined, making the shot aircraft fly in a circling pattern with the circling radius changeable.

1 Claim, 5 Drawing Sheets

TOY AIRCRAFT CAPABLE OF CIRCLING IN CHANGEABLE RADIUS

BACKGROUND OF THE INVENTION

The present invention relates to a top aircraft which can be shot out and then fly in a CIRCLING pattern.

Aircraft may freely fly in the sky like birds which intrigues anyone who knows airplanes, even a small child. Many school children often use paper-folded airplanes to entertain themselves by throwing the paper planes into air.

For an aircraft to fly in the sky like a bird, there must be a force of the aircraft to resist the gravity. In the structure of an aircraft, the wings (which equivalent to the wings of birds) are employed to obtain an ascending force normal to the flying direction of the aircraft. With sufficient power to generate necessary flight speed, the ascending force shall be able to overcome the gravity and thereby keeps the aircraft to fly in the sky for a long period. Furthermore, to reduce the resistance and generate ascending force, the wings of the aircraft must be adequately designed such that they are streamlined and properly inclined to provide the air a longer flow route above the wings and thereby allow the aircraft to fly at higher speed. According to the Bernoulli's theorem, for a fluid or a gas, the higher its flow speed is, the lower its pressure is; when the flow speed reduces, the fluid or the gas shall provide higher buoyancy and therefore higher pressure. Since air above the wings of the aircraft has a higher flow speed, the pressure it applies on the top surface of the wings is lower than the pressure below the wings and thereby allow the aircraft to generate ascending force.

Since there are more and more people who love and enjoy toy aircraft, multiple model aircraft, including remotely controlled ones, are developed to serve as entertaining implements or toys. However, the weight and gravitational center of these model aircraft cannot be changed so that the circling radius thereof is not controllable and adjustable by the player.

Therefore, it is desirable to provide a toy aircraft the weight and gravitational center of which are changeable, permitting the player to control the flying route of the aircraft.

SUMMARY OF THE INVENTION

It is an object of the present invention to provide a toy aircraft the weight and gravitational of which can be conveniently and properly controlled to allow the toy aircraft to fly in changeable circling radius. The toy aircraft according to the present invention mainly includes a fuselage, two wings disposed on two sides of the fuselage, and two rudders disposed on the wings, wherein multiple weight-adjusting recesses are longitudinally arranged on a top portion of the fuselage and arranged on upper rear portions of the wings at predetermined intervals, whereby multiple weight-adjusting ball members can be placed in the recesses and the locations or weight of the ball members can be changed to freely adjust the weight and gravitational center of the toy aircraft. The rudders can be slightly outward inclined so that the aircraft can fly in circling pattern with the circling radius changeable. Such toy aircraft would give both the effect of entertainment and intellectual learning.

DETAILED DESCRIPTION OF THE PREFERRED EMBODIMENTS

Figure 1:
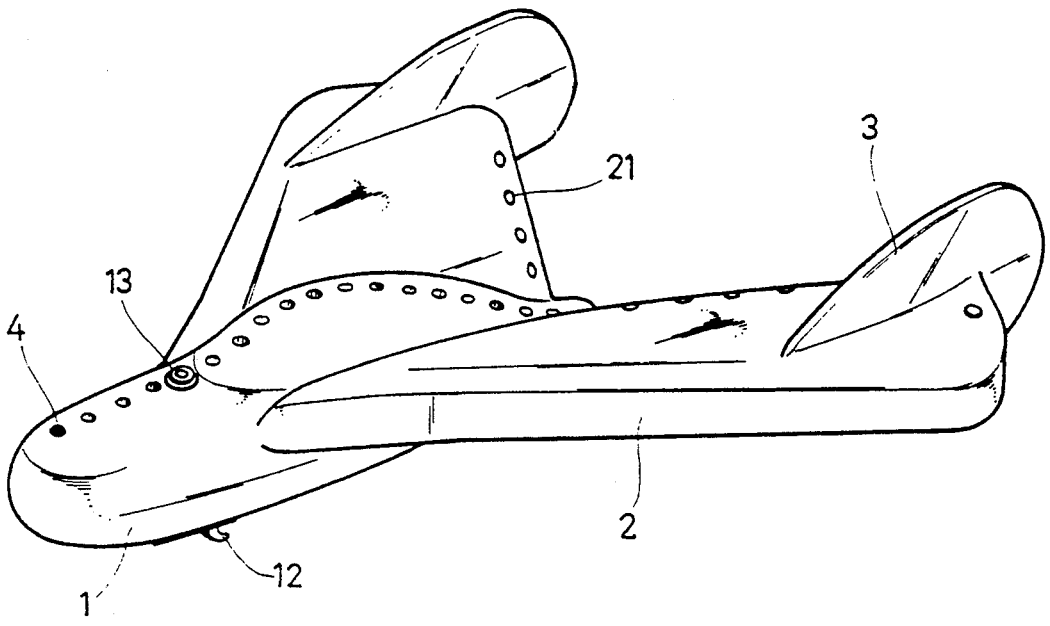
FIG. 1 is a perspective view of the present invention.
Figure 2:
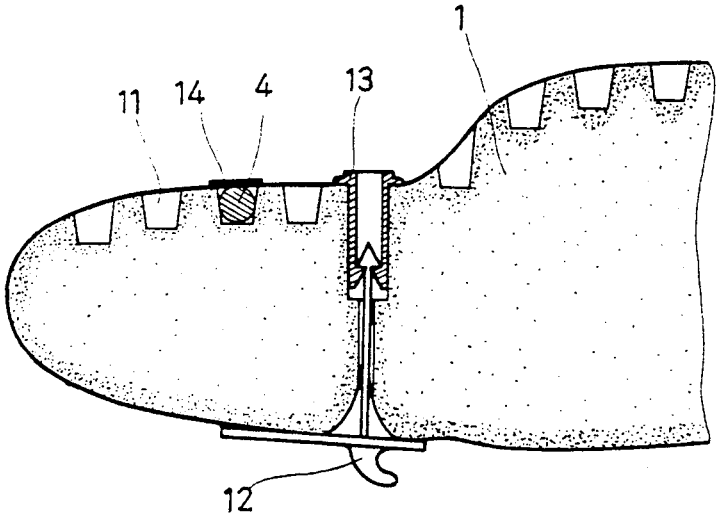
FIG. 2 is a sectional view showing the weight-adjusting recesses disposed on the top of the fuselage.
Figure 5:
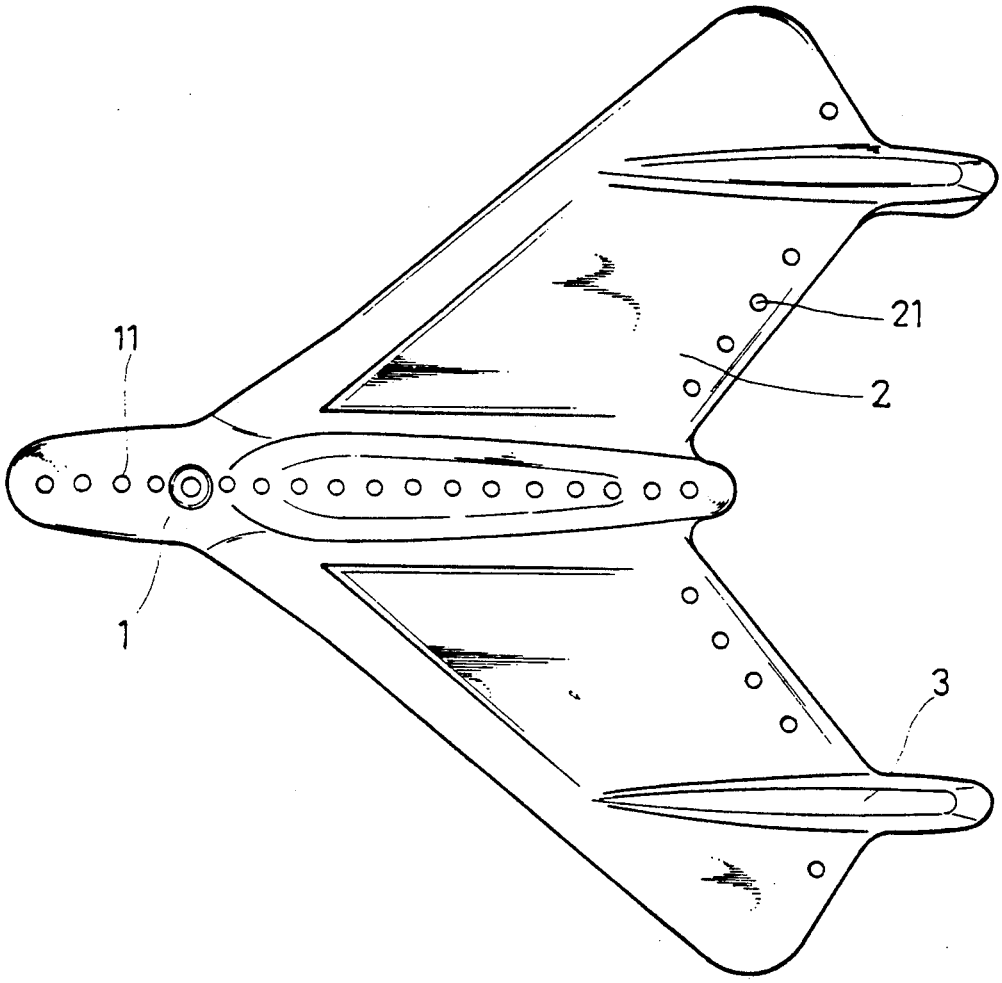
FIG. 5 is a top view of the present invention.

Please refer to FIG. 1. The toy aircraft of the present invention is integrally made of light weight material, and includes a fuselage 1 an upper portion of which is formed with multiple weight-adjusting recesses 11, two wings 2 located on two sides of the fuselage 1 for creating ascending effect, two rudders 3 located at rear ends of the wings 2, wherein the wings 2 are suitably inclined and curved for achieving better ascending effect and multiple suitably spaced weight-adjusting recesses 21 formed on upper rear sides of the wings 2 as shown in FIG. 5. The weight-adjusting recesses 11 of the fuselage 1 are spaced at predetermined intervals and arranged in longitudinal central line of the fuselage 1 from a head portion of the fuselage 1 to a tail portion thereof. Referring to FIG. 2, the cross-section of each of the recesses 11 (and 21) is frustum-shaped suitable for fitting a weight-adjusting ball member 4 therein, whereby the gravitational center of the toy aircraft can be changed by means of placing the ball members 4 in different recesses 11, 21. Because the recesses 11, 21 are disposed on the top of the fuselage 1 and the rear side of the wings 2, the gravitational center can be easily changed. After the ball member 4 is placed into the recess 11, 21, a self-adhering adhesive paper 14 can be attached to the recesses 11, 21 for preventing the ball member 4 from dropping out during flying of the toy aircraft.

Figure 3:
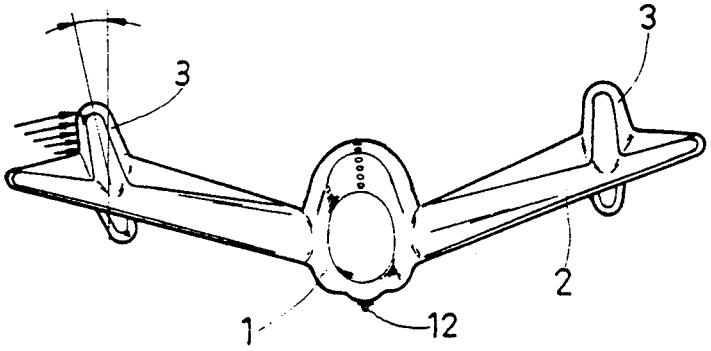
FIG. 3 is a front view showing the outward inclined right rudder.
Figure 4:
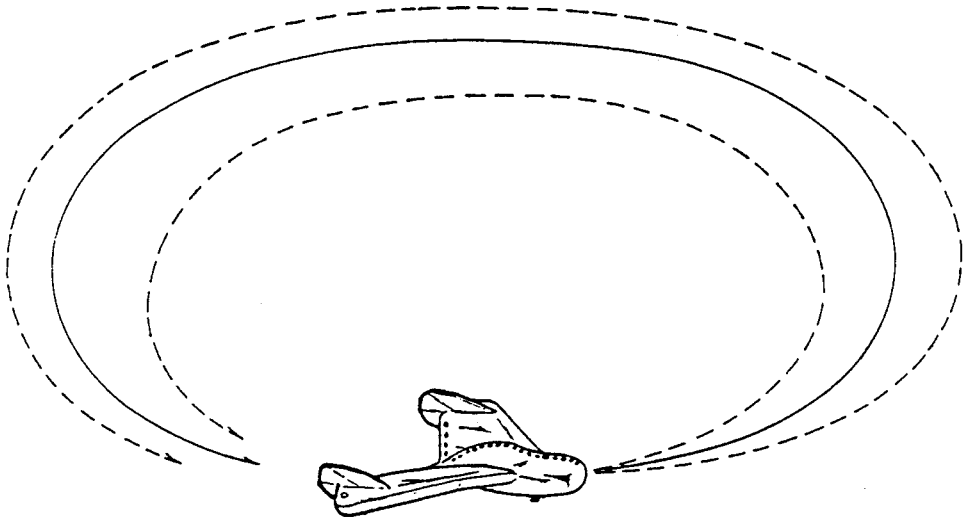
FIG. 4 illustrates the flying route of the present invention.

Referring to FIG. 3, the right rudder 3 is slightly outward inclined while the left rudder 3 is vertically disposed on the left wing 2, whereby when the toy aircraft is thrown forward and upward, the right rudder 3 suffers an upward and inward force which tends to make the right rudder 3 vertical. As a result, the fuselage 1 circles counter-clockwise and a centripetal force is created to make the toy aircraft circle or even fly back to the original shooting position as shown in FIG. 4.

Please now refer to FIG. 2. A through hole is formed on the fuselage 1 and a sleeve member 13 is fitted in the through hole. A hook member 12 having an upper arrow section is fitted in the through hole with the arrow section inserted in the sleeve member 13, whereby an elastic shooting means such as a rubber ring can be connected with the hook member 12 for shooting the toy aircraft by elastic force. Referring to FIG. 4, when the toy aircraft is shot out by appropriate elastic force, the inclined right rudder 3 will cause the toy aircraft to fly in a circling pattern. The flying route of the toy aircraft is subject to the outer configuration of the aircraft, the weather (humid or dry), wind, shooting force, gravitational center of the aircraft, the weight of the aircraft, the shooting angle, etc. Therefore, when the outer configuration of the aircraft is fixed and the wind is not so strong, the flying route of the toy aircraft can be under control.

According to the law of inertia, the heavier the aircraft is (in an acceptable range), the larger the flying distance or the circling radius is. Reversely, the lighter the aircraft is, the smaller the flying distance or the circling radius is. During the initial flying stage, the route of the aircraft is more affected by the inertia, and, while in the final flying stage, the route of the aircraft is otherwise more affected by the gravitational center of the aircraft. In case the head of the aircraft is pulled upward, the aircraft will slowly glidingly land, while in case the head of the aircraft is pulled downward, the aircraft will speedily rush onto the ground.

According to the above arrangement, when heavier or more ball members 4 are placed in the recesses 11 or 21, the weight of the aircraft is increased and the circling radius is enlarged due to the law of inertia. Reversely, the weight of the aircraft with less ball members 4 is decreased and the circling radius is reduced. On the other hand, when the ball members 4 are placed only in the recesses 11 of the head of the fuselage 1, the gravitational center will reside in the head of the fuselage 1 to pull the same downward and thus increase the circling radius and descending speed. While when the ball members 4 are placed in the recesses 11 of the tail of the fuselage 1, the gravitational center of the aircraft will reside in the tail of the fuselage 1, making the head thereof facing upward and reducing the circling radius and descending speed. Alternatively, when the ball members 4 are placed only in the recesses 21 of the left wing 2, the left circling radius will be reduced. Accordingly, by means of suitably adjusting the position of the gravitational center of the aircraft, the toy aircraft can circle back to the original shooting position. Moreover, by means of changing the locations of the ball members 4 in the recesses 11, 21 or changing the weight of the ball members 4, via a sufficient shooting force, the toy aircraft can circle by different radius. In addition, both the left and right rudders 3 can be slightly inclined, causing the toy aircraft to circle in different directions. It should be noted that the above weight-adjusting recess arrangement can be substituted by other equivalent measures to achieve the same effect.

The toy aircraft of the present invention can be played indoors or outdoors and the flying route thereof can be controlled by means of the weight-adjusting recesses and ball members. This creates great entertaining and educational effects.

What is claimed is:

1. An integrally formed toy aircraft capable of circling in controllable and changeable radius, comprising a fuselage, two wings disposed on two sides of said fuselage and two rudders disposed on said wings, wherein a hook member is disposed under said fuselage for connecting with an elastic shooting means to shoot said aircraft, said aircraft being characterized in that multiple weight-adjusting recesses are longitudinally arranged on a top portion of said fuselage and arranged on upper rear portions of said wings at predetermined intervals, whereby multiple weight-adjusting ball members can be placed in said recesses and the locations or weight of said ball members can be changed to freely adjust the weight and gravitational center of said toy aircraft, at least one of said rudders being slightly inclined so as to make said toy aircraft fly in a circling pattern with the circling radius changeable.

* * * * *